United States Patent [19]

Howell

[11] Patent Number: 4,805,854

[45] Date of Patent: Feb. 21, 1989

[54] GATE CIRCUITRY FOR HOT BOX DETECTORS

[75] Inventor: Roland A. Howell, Harrison, Tenn.

[73] Assignee: Southern Railway Company, Norfolk, Va.

[21] Appl. No.: 18,443

[22] Filed: Feb. 25, 1987

[51] Int. Cl.[4] ..... B61L 3/10

[52] U.S. Cl. ..... 246/169 D; 246/169 A; 340/584; 340/682

[58] Field of Search ..... 246/169 A, 169 D, DIG. 1, 246/DIG. 2, 249; 340/682, 584, 587; 116/DIG. 38

[56] References Cited

U.S. PATENT DOCUMENTS

| | | | |
|---|---|---|---|
| 2,829,267 | 7/1957 | Howell | 246/169 A |
| 2,963,575 | 5/1969 | Pelino et al. | 246/169 A |
| 3,263,090 | 7/1966 | Blocher | 246/169 D |
| 3,313,933 | 9/1962 | Sibley | 246/169 D |
| 3,646,343 | 2/1972 | Caulier et al. | 246/169 D |
| 3,697,744 | 10/1972 | Howell | 246/169 D |
| 3,731,087 | 11/1972 | Kidg | 246/169 D |

*Primary Examiner*—John W. Caldwell, Sr.
*Assistant Examiner*—Alvin Oberley
*Attorney, Agent, or Firm*—Watson Cole Grindle & Watson

[57] ABSTRACT

A gating circuit and method for controlling the output of data from the scanner of a heat detector in response to a bi-polar signal indicating the presence of an object within the scanning window of the heat detector; stores the data output; senses the stored data with respect to a reference signal with a differential amplifier responsive to the data output; gates the data output to storage by a first gate interconnecting the data output with the differental amplifier; generates control signals for opening and closing the gate with different states of the bi-polar signal for controlling the gate such that the reference signal represents the last immediate data output; detects the difference between the stored peak value and the highest data value of the output data subsequent to turning off a first gate; and using a second gate interconnecting the output of the sensor with the detector and controlled by the control signals to be open with the first gate closed and closed with the first gate open.

8 Claims, 4 Drawing Sheets

GATE CIRCUITRY FOR HOT BOX DETECTORS

BACKGROUND OF THE INVENTION

1. Field of the Invention

The apparatus of this invention relates to detectors for detecting hot boxes on railroad cars, and more particularly to such detectors for automatically scanning journal boxes on railroad cars by passage of the railroad cars within the window of a trackside scanner.

Certain hotbox detectors now in use in the railroad industry provide numerous false indications because of a loss of a background reference. With such hotbox detectors, the trackside scanners are aligned such that the undercarriage or floor of a passing railroad car appears as a background source of reference radiation. Such a background reference is normally near ambient temperature, and it is the difference in temperature between such a background reference temperature and the journal bearing temperature itself, when the journal bearing passes within the detection window of the scanner mechanism and the temperature is detected, that generates a detector output signal.

With certain types of rolling stock now in use there are certain instances when the aforementioned background reference is completely lost as, for example when the hotbox scanner views the sky. When that occurs, the hotbox scanner references on an extremely cold temperature, assuming the sky to be clear, and as the railroad car body comes within the scanner window, the hotbox detector outputs a high output pulse as the normal background reference is re-established. The erroneous high hotbox detector output signal can be of a rather long duration because of the low frequency characteristics of the hotbox scanner itself. If such an erroneous hotbox detector output signal occurs on a moderate to high speed train, it is possible for a journal to pass within the scanner window while the hotbox detector output is still "high" from the change in the temperature reference as discussed above. This results in an erroneous hotbox detector output indication which is the sum of the signal generated by the change of background reference plus the heat pulse from the journal bearing being scanned.

2. Prior Art

U.S. Pat. No. 2,829,267, entitled Hot-Box Detector, discloses an auxiliary shutter actuated by a capacitance-resistance timer circuit to be opened for train speeds effectively exceeding a threshold speed. For lower train speeds, the shutter is closed to prevent saturation or loss of sensitivity of the detector circuitry.

U.S. Pat. No. 2,963,575, Entitled "Hot-Box Detector Alarm Circuit", discloses a gate circuit to assure that the hotbox detector effectively only looks at journal boxes to the exclusion of all other matter passing within the field of view of the detector-response axes. Electromagnetic wheel trips are employed to develop suitable pulse outputs whenever wheel flanges enter the magnetic air gap of the hotbox detector to clearly identify the instant at which each wheel center passes a particular point along the track. Thus, gating only occurs when the detector-response axes are imaged on opposed journal boxes for the same axle. The gate pulses control the entry of temperature data into a capacitance-type storage device.

U.S. Pat. No. 3,313,933, entitled "Integrity Check for Hot Box Detector", discloses an infrared signal for simulating the journals of railway cars, but does not disclose gating circuitry used in conjunction with the hotbox detector circuitry for operating a shutter element to a non-blocking position by successive operation of a wheel detector mechanism. The wheel detector mechanism provides a signal output for the passage of each wheel of a railway car as it passes between a pair of oppositely disposed radiometer detectors. The operation of the gate circuitry prevents extraneous infrared energy, such as solar energy, from being sensed by the hotbox detectors, thereby preventing erroneous detections.

U.S. Pat. No. 3,646,343, entitled "Method and Apparatus for Monitoring Hot Boxes", uses wheel sensors indicating wheel passage to actuate sensors to generate analog signals proportional to the magnitude of the journal heat sensed.

In U.S. Pat. No. 3,731,087 entitled, "Hot Box Alarm System", there is incidental disclosure pertaining to wheel trip sensor circuitry and associated gate circuitry for ensuring that the journal sensors produce signals that indicate the temperature of the journal boxes and not the temperature of extraneous heat-producing objects. However, the particulars of the gate circuitry are not disclosed.

SUMMARY OF THE INVENTION

The gate circuitry of the present invention for hotbox detectors overcomes the aforementioned loss of background reference inherent with presently employed hotbox detector systems. The trackside scanners are aligned to allow the undercarriage or floor of a passing railway car to appear as a background source of reference radiation. The background reference is normally close to ambient temperature and the difference in the temperature between such background and the journal bearing itself, when in the scanning window of the hotbox detector, generates a heat pulse output by the hotbox detector.

Loss of the background reference temperature, such as when the scanner views the sky, provides an abnormally "cold" temperature reference. Therefore, when the car body comes back into the window of the scanner, a high detector output pulse is emitted as the normal background is re-established. Erroneous journal temperature indications that would result from such operation are prevented by the gate circuitry of the present invention even though the detector scans the journal when the scanner mechanism is subject to such an erroneous temperature reference.

The operation of the gate circuit of the invention is such that the heat pulse from the detector is always referenced from a point immediately prior to the journal entering the field of view of the scanner mechanism. Thus, even though the scanner output may be high because of the aforementioned change in the reference background, the heat pulse output of the detector scanner is referenced from the upper limit of the pulse, and therefore the output of the hotbox detector will be only that generated by the detected heat from the journal being scanned.

Heat signals from the scanner head of the hotbox detector are applied to both inputs of a differential amplifier, one input being through an analog switch which is normally biased "on". The gate circuit utilizes two channels, one channel for each rail. Any output from the detector scanner is cancelled as a result of the operation of the differential amplifier in each of the two channels. However, as a wheel moves into the scanning area or window, signals from a rail-mounted gating transducer activate a gate generator to open the analog switch of the differential amplifier, and any signal that was present before the switch opens remains stored on a pair of parallelly-connected capacitors at the inverting input of the differential amplifier. Thus, as the journal comes into the scanner field of view, only that portion of the signal above that stored on the capacitors is amplified by the non-inverted input of the differential amplifier.

The amplified signals are stored by yet another capacitor in a peak read circuit and read out for the period of a gate pulse generated by the gate generator, or a fixed period of read-out of the read out generator, whichever is longer.

The pair of differential amplifiers are controlled by a gate generator which generates control signals from a rail-mounted magnetic transducer positioned at a point on the rail where, as the journal bearing comes into view of the scanner, the wheel passing the transducer generates a sinusoidal signal. The sinusoidal signal is polarized such that, as the wheel approaches, the signal swings positive, and then negative as the wheel leaves the region of the transducer. The sinusoidal transducer output signal is applied to switching and logic circuitry for generating control signals for controlling the closing or opening of respective analog switches in each of the differential amplifier circuits and respective analog switches in the peak read circuitry. When the analog switches in the differential amplifiers are open, the peak read circuit analog switches are reversed and vice-versa. The opening of the analog switches in the differential amplifiers prevents any further data from being accumulated in the respective storage capacitors thereof. In such a state, only that portion of a heat detector signal exceeding that level stored in the aforementioned storage capacitors is output from the respective differential amplifiers.

Further processing of the sinusoidal signal by the aforementioned switching and logic circuitry causes the respective analog switches in the differential amplifier circuits and the peak read circuitry to reverse their aforementioned status. This enables data detected and stored in the peak read circuits to be output therefrom.

BRIEF DESCRIPTION OF THE DRAWINGS

The above objects, features and advantages of the invention are readily apparent from a consideration of the following specification taken in conjunction with the drawings of a preferred embodiment of the best mode of carrying out the invention, wherein.

DETAILED DESCRIPTION OF THE PREFERRED EMBODIMENT

Figure 1:
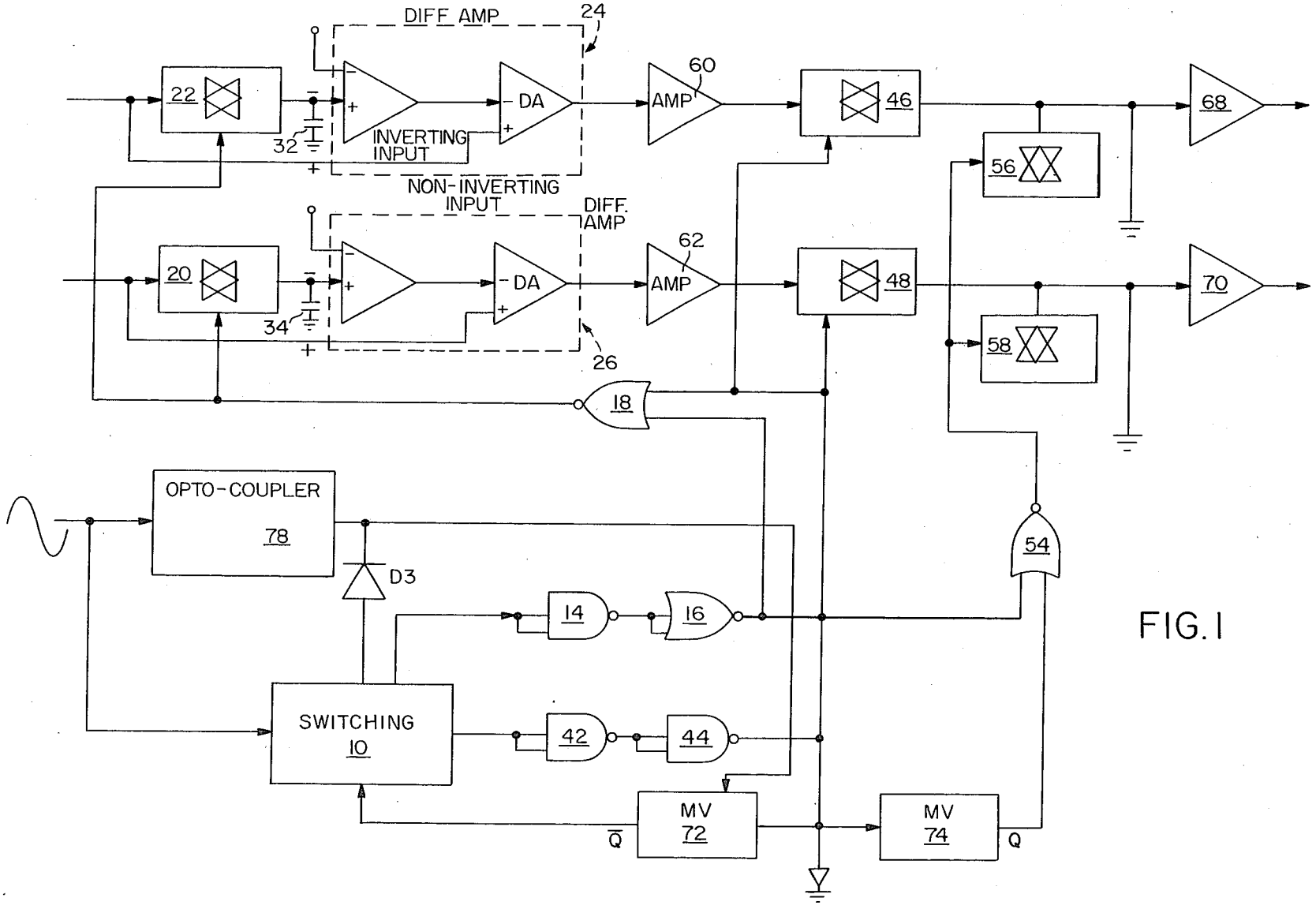
FIG. 1 illustrates the gating control circuit of the invention in block diagrammatic format.
Figure 2A:
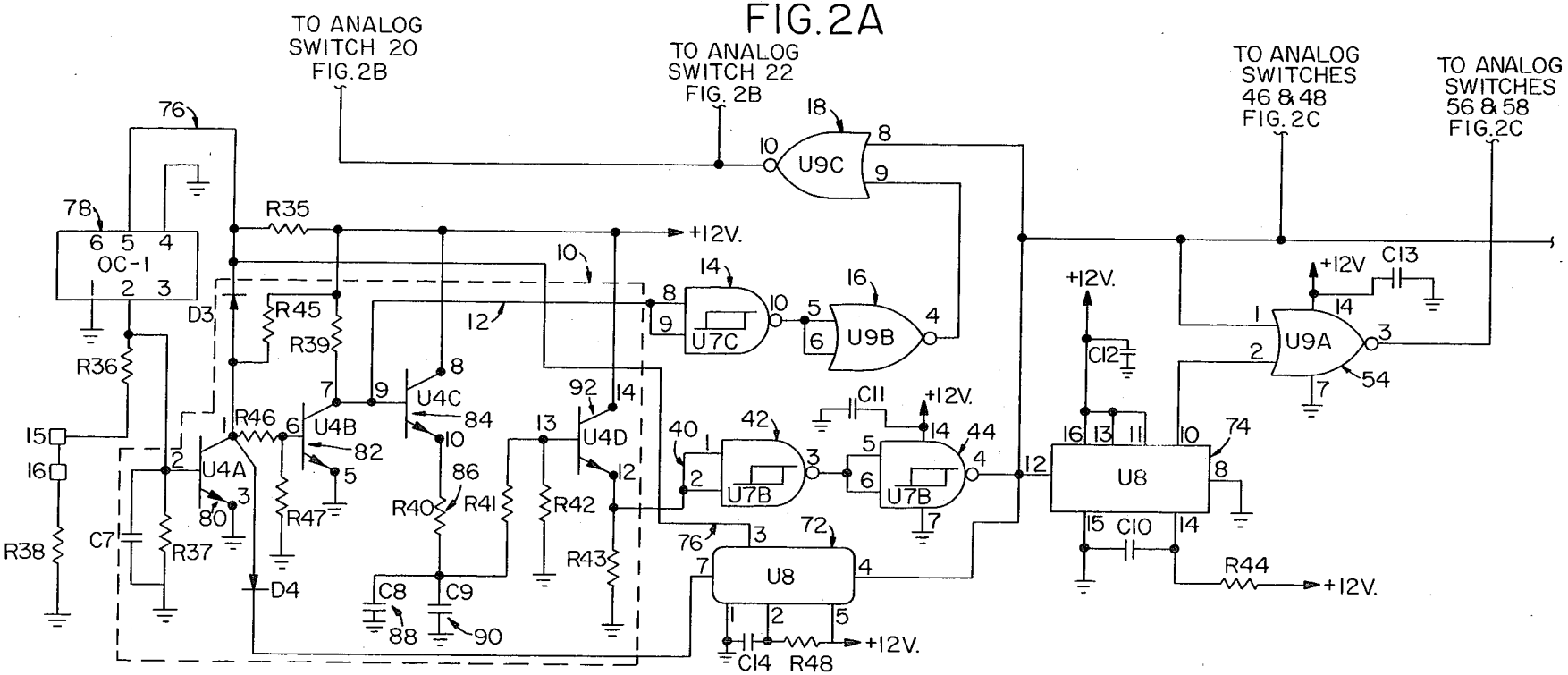
FIGS. 2A, 2B and 2C are combined block diagrams and electrical schematics, each representing a portion of the gating control circuit shown in FIG. 1.
Figure 2B:
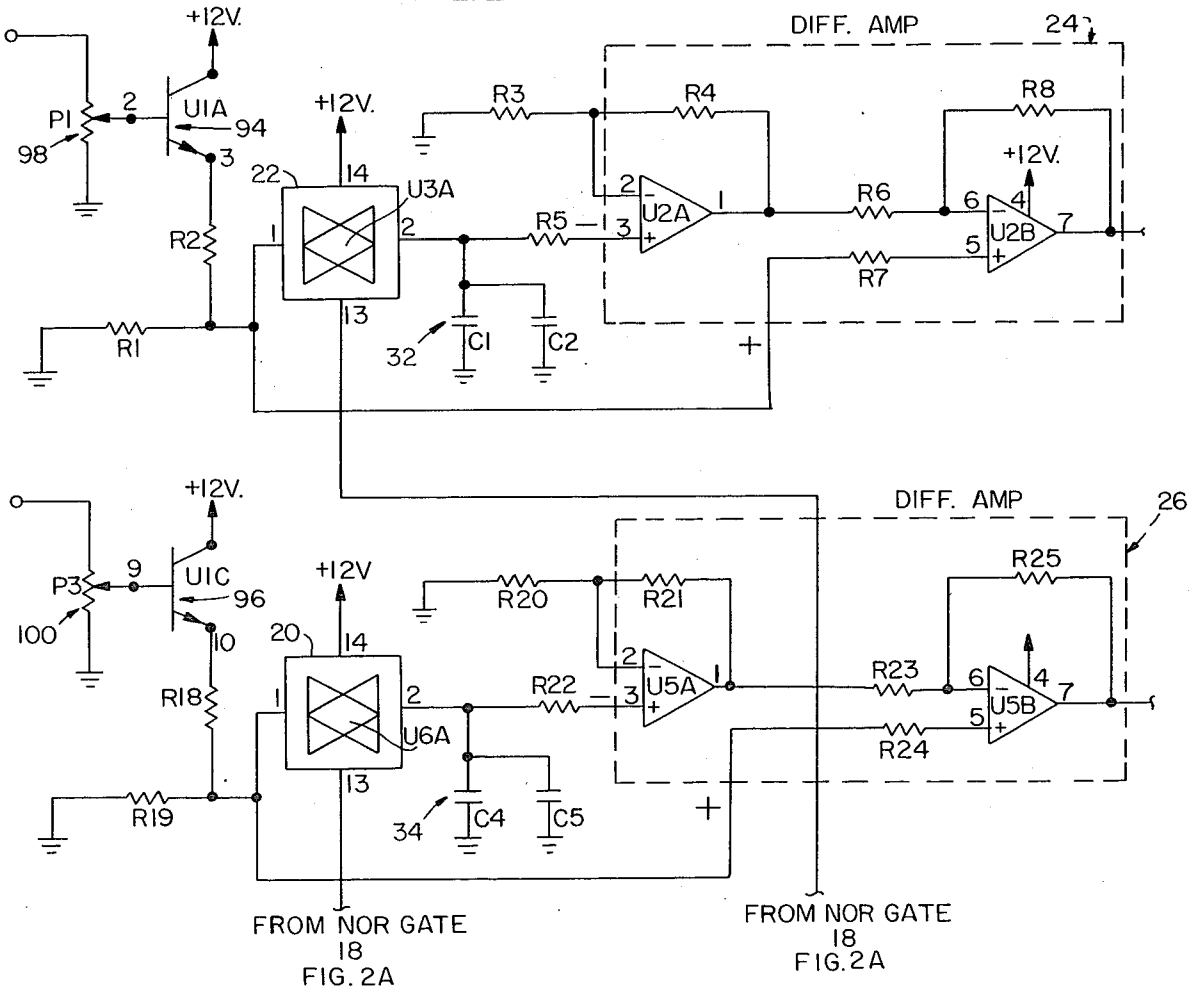
Figure 2C:
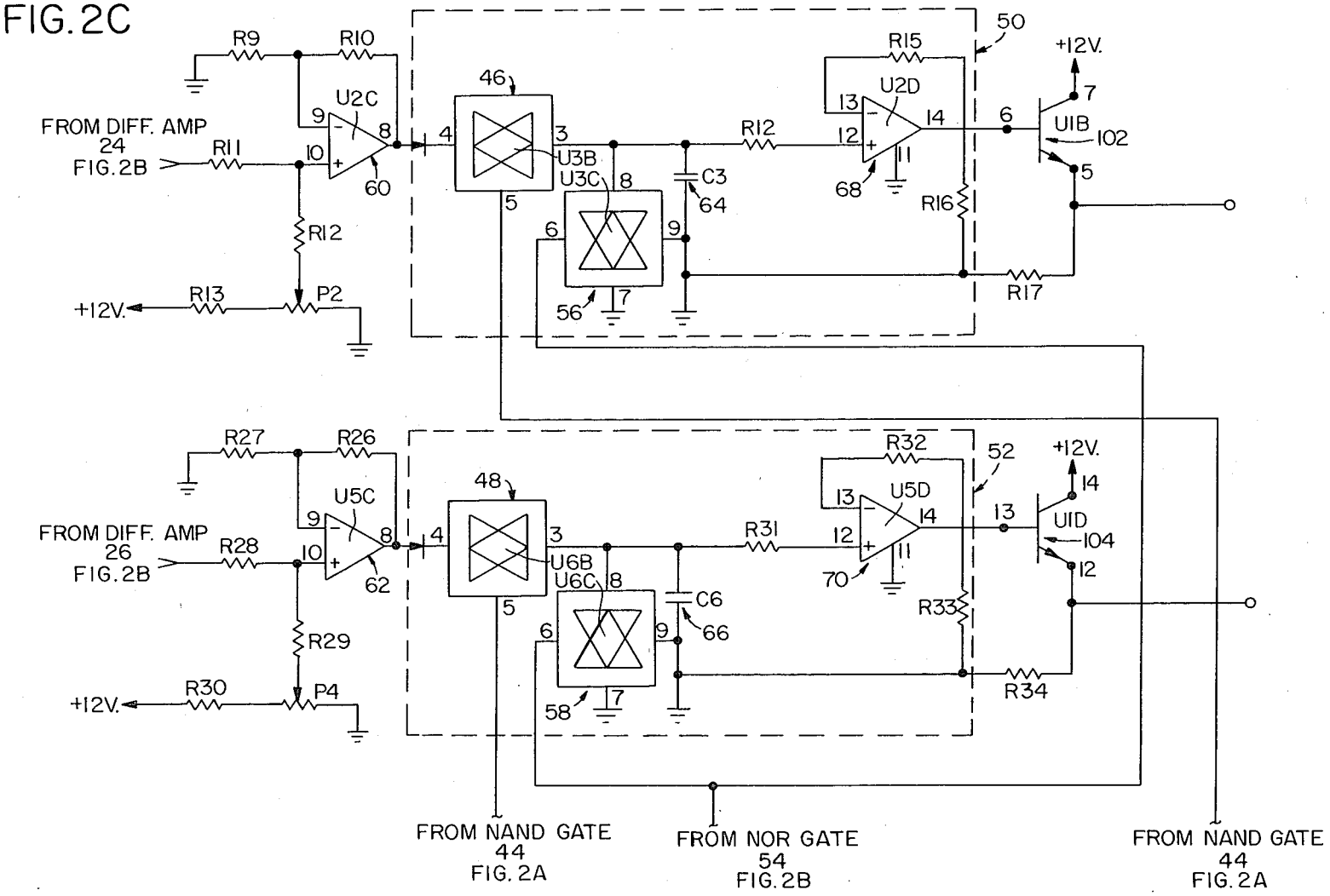

The following description is taken with respect to FIG. 1 and specified Figures of FIGS. 2A, 2B and 2C.

The rail-mounted transducer (not shown and known to those skilled in the transducer and detector art) is positioned on the rail at a point where, as the journal bearing comes into the detector window of the hotbox scanner (not shown and also known to those skilled in the art of hotbox detectors), the wheel passing the transducer generates a sinusoidal signal, which is polarized such that, as the wheel approaches, the sinusoidal signal swings positive, and then negative as the wheel exits from the scanner window. With continuing reference to FIG. 1 and additional reference to FIG. 2A, the sinusoidal output of the magnetic transducer is input to switching circuit 10 which causes a positive pulse to appear on line 12 as well as internally within switching circuit 10 for additional control functions to be described more fully hereinafter. The positive pulse on line 12 is input to Schmitt trigger nand gate 14 connected as an inverter. The output of inverter 14 is then driven to a logic "0", which is input to NOR gate 16 connected as an inverter. The logic "1" output of inverter 16 is input to one input of NOR gate 18, thereby causing the output thereof to be a logic "0". With continuing reference to FIG. 1 and additional reference to FIG. 2B, the logic "0" output of NOR gate 18 controls analog switches 20 and 22 at the input of differential amplifier circuits 24 and 26, respectively. The logic "0" causes analog switches 20 and 22 to open, thereby preventing any further signals from the preamplifiers from accumulating on storage capacitors 32 and 34, respectively. Thus, only that portion of the input signals, the level of which is greater than that which is stored on capacitors 32 and 34, will be amplified by differential amplifiers 24 and 26, respectively.

With continuing reference to FIG. 1 and further reference to FIG. 2A, the positive pulse on line 12, which is also applied internally within switching circuit 10, is integrated therein and appears as an output on line 40 to be input to Schmitt trigger nand gate inverter 42. As the integrated signal rises above the threshold of inverter 42, the output thereof becomes a logic "0", which is coupled to nand gate inverter 44 to provide a logic "1" output therefrom. With additional reference to FIG. 2C, that logic "1" output is connected to control analog switches 46 and 48 in the peak read circuits 50 and 52, thereby closing those analog switches. The logic "1" output from inverter 44 is also connected to one input of NOR gate 54 to drive the output thereof to a logic "0" which controls analog switches 56 and 58 to open them. Thus signals from summing amplifiers 60 and 62 are allowed to pass and are stored on capacitors 64 and 66. The signals stored on storage capacitors 64 and 66 are read out through amplifiers 68 and 70.

With continuing reference to FIG. 1 and further reference to FIG. 2A, the logic "1" output of inverter 44 is also input to one-shot multivibrator 72 and one-shot multivibrator 74. One-shot multivibrator 72 has a period of 75 ms and the "Q" output is coupled to the collector of transistor 80. As the wheel passes the center of the gating transducer, the transducer output becomes negative, and the negative output from the gating transducer causes a low output signal on line 76 of optical gate 78, which low signal is applied to reset one-shot multivibrator 72. The low signal is also applied to switching circuit 10 to ensure that analog switches 20 and 22 remain open until the wheel has traversed the transducer.

One-shot multivibrator 74 has a period of 22 ms and the "Q" output thereof is coupled to the other input of NOR gate 54 to ensure that the minimum readout period of the stored pulses on capacitors 64 and 66 is a minimum of 22 ms.

A detailed schematic of the gate control circuit of a preferred embodiment of the invention is shown by the combination of the circuitry shown in FIGS. 2A, 2B and 2C. The following description of the gate control circuit is directed to certain of the additional components illustrated in those Figures. Furthermore, there is no description of, for example, the various resistors used to bias transistors, to provide feedback for amplifiers, etc. The function of such components is well known to those skilled in the design and implementation of logic control circuits such that the gate control circuit can be used as shown and described herein.

As stated previously, the operation of the inventive gate control circuit is such that the heat pulse from the hotbox detector is always referenced from a point immediately before the journal enters the hotbox detector window. Thus, even though the hotbox detector scanner output may be high because of changes in the reference background, the heat pulse output of the hotbox detector scanner is referenced from the upper limit of the pulse and, therefore the output of the hotbox detector will be only that generated by the detected heat from the journal being scanned.

With reference to FIG. 2A, the sinusoidal wheel transducer output signal is input to switching circuit 10 through the base of transistor 80, thereby causing the collector thereof to go negative and removing the forward bias from the base of transistor 82. The collector of transistor 82 then rises to the +12 volt collector voltage and that positive pulse is applied to Schmitt trigger NAND gate inverter 14 via line 12 as previously described with respect to FIG. 2A. Simultaneously therewith, the positive pulse applied to the base of transistor 84 causes it to conduct, and the current of transistor 84 is slightly integrated by resistor 86 and the parallelly connected capacitors 88 and 90, which also filters high frequency noise. The integrated current is applied to the base of transistor 92 connected as an emitter follower, which outputs the previously described input to Schmitt trigger NAND gate inverter 42.

The operation of the analog switches 20, 22, 46, 48, 56 and 58 of FIG. 1 is then controlled by the respective logic outputs of NOR gates 18 and 54 as described herein with respect to FIGS. 2A, 2B and 2C.

In FIG. 2B, the output of the known hotbox detector is applied to the analog switches 20, 22 respectively through emitter followers 94 and 96, each having a base connected through adjusting potentiometers 98 and 100. Similarly, the output of that portion of the gate control circuit illustrated in FIG. 2C is taken respectively from emitter follower transistors 102 and 104. These outputs are transmitted to a strip chart recorder, for example.

The method may be modified to utilize digital techniques by converting the data output from the scanner of the heat detector into digital format, storing the last number of said data immediately prior to the object moving into the scanning window of the heat detector, subtracting said last number from the highest number received with the object in the scanning window of the heat detector, and outputting the difference from said subtraction as an output representative of the heat detector output.

Those skilled in the art of hotbox detectors and gate circuitry will recognize that there are many modifications of the preferred embodiment of the invention described above, and that therefore the foregoing description is not to be construed as limiting the invention to the particular components described. The scope of the invention is intended to be defined by the following claims with consideration to equivalents of the components set forth therein.

TABLE OF COMPONENTS

| COMPONENT | VALUE OR TYPE |
|---|---|
| R1, R2, R18, R19, R36 and R40 | 470 Ohms |
| R3, R4, R5, R6, R7, R8, R10, R11, R12, R14, R15, R20, R21, R22, R23 R24, R25, R26, R28, R29, R31 and R32 | 100K Ohms |
| R9 and R27 | 68K Ohms |
| R13 and R30 | 27K OhmS |
| R16, R33, R39 and R47 | 10K Ohms |
| R17 and R34 | 3.3K Ohms |
| R35, R37, R45 and R46 | 15K Ohms |
| R38 | 2.2K Ohms |
| R41 and R43 | 4.7K Ohms |
| R42 | 110K Ohms |
| R48 | 330K Ohms |
| R49 | 1 Megohm |
| N.B. All resistors ¼ watt plus or | /minus 5% |
| C1, C2, C3, C4, C5, C6, C8, C9 and C14 | 1 microFarad |
| C7, C10, C11, C12 and C13 | .1 microFarad |
| P1, P2, P3 and P4 | 10K Ohm Potentiometer |
| Transistors 80, 82, 84, 92, 94, 96, 102 and 104 | MPQ-2222 |
| Analog Switches 20, 22, 46, 48, 56 and 58 | MC-14066BCP |
| Operational Amplifiers u2A, u2B, u2C, u2D, u5A, u5B, u5C and u5D | LM-324N |
| One-Shot Multivibrators 72 and 74 | MC-14528BCP |
| Optical Gate 78 | H11B1 |
| NAND Gates (inverters) 14, 42 and 44 | MC-14093BCP |
| NOR Gate (inverter) 16 | MC-14001BCP |
| NOR gates 18 and 54 | MC-14001BCP |
| All diodes | dc isolation |

What is claimed is:

1. A gating circuit for controlling the output of data from the scanner of a heat detector in response to a bi-polar signal indicating the presence of an object within the scanning window of the heat detector, comprising:

means for storing said data output;

means for sensing the stored data with respect to a reference signal and including a differential amplifier responsive to said data output;

means for gating said data output to said storing means and including a first gate interconnecting said data output with said differential amplifier;

means responsive to said bi-polar signal to generate control signals for opening and closing said gate with different states of said bi-polar signal for controlling said gating means such that said reference signal represents the last immediate data output;

means for detecting the difference between the peak value stored in said storing means and the highest data value of said output data subsequent to turning off said first gate; and said gating means further including a second gate interconnecting the output of said sensing means with said means for detecting and controlled by said control signals to be open with said first gate closed and closed with said first gate open.

2. A gating circuit as claimed in claim 1, wherein said sensing means includes said means for storing and being connected to receive the output of said first gate, and said means for detecting includes a second means for storing.

3. A gating circuit as claimed in claim 2, wherein said means for controlling includes respective switching means for generating first and second control signals for respectively controlling said first and second gates.

4. A gating circuit as claimed in claim 3, wherein said means for controlling further includes means for determining respective fixed periods of operation for said first and second control signals.

5. A gating circuit as claimed in claim 2, wherein said gating means further includes a third gate for controlling the data stored by said second means for storing and said means for controlling further includes means for generating a third control signal for controlling the opening and closing of said third gate in conjunction with the opening and closing of said first and second gates.

6. A gating circuit as claimed in claim 1, wherein said bi-polar signal is sinusoidal and generated by the passage of railway wheels through the window of said heat detector.

7. A method for controlling the gating of data output from the scanner of a heat detector in response to a bi-polar signal indicating the presence of an object within the scanning window of the heat detector, comprising the steps of:

storing said data output;

sensing the stored data with respect to a reference signal with a differential amplifier responsive to said data output;

gating said data output to said storing means by a first gate interconnecting said data output with said differential amplifier;

generating control signals for opening and closing said gate with different states of said bi-polar signal for controlling said gating means such that said reference signal represents the last immediate data output;

detecting the difference between the peak value stored in said storing means and the highest data value of said output data subsequent to turning off said first gate; and controlling a second rate interconnecting the output of said sensing means with said means for detecting and controlled by said control signals to be open with said first gate closed and closed with said first gate open.

8. The method as claimed in claim 7, further comprising converting the data output from the scanner of the heat detector into digital data, and wherein said step of detecting including storing the last number of said digital data representing said data output immediately prior to the object moving into the scanning window of the heat detector, said step of detecting further including the step of subtracting said last number from the highest number of said digital data representing said data output received with the object in the scanning window of the heat detector, and further comprising the step of outputting the difference from said step of subtracting as an output representative of the heat detector output.

* * * * *